US008556664B2

(12) United States Patent
Aase

(10) Patent No.: US 8,556,664 B2
(45) Date of Patent: Oct. 15, 2013

(54) PLUG ASSEMBLY WITH CORE STRUCTURAL MEMBER

(75) Inventor: Jonathan Aase, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/090,976

(22) Filed: Apr. 20, 2011

(65) Prior Publication Data

US 2011/0256779 A1 Oct. 20, 2011

Related U.S. Application Data

(60) Provisional application No. 61/326,102, filed on Apr. 20, 2010, provisional application No. 61/384,097, filed on Sep. 17, 2010.

(51) Int. Cl.
*H01R 24/04* (2006.01)

(52) U.S. Cl.
USPC ..... 439/668

(58) Field of Classification Search
USPC ..... 439/668, 669
See application file for complete search history.

(56) References Cited

U.S. PATENT DOCUMENTS

| | | | | |
|---|---|---|---|---|
| 6,439,933 | B1 * | 8/2002 | Moji | 439/669 |
| 7,853,302 | B2 * | 12/2010 | Rodriguez et al. | 600/374 |
| 7,899,548 | B2 * | 3/2011 | Barker | 607/116 |
| 8,126,557 | B2 * | 2/2012 | Jang et al. | 607/37 |
| 8,182,293 | B2 * | 5/2012 | Tang et al. | 439/668 |

* cited by examiner

*Primary Examiner* — Phuong Dinh
(74) *Attorney, Agent, or Firm* — Kilpatrick Townsend & Stockton LLP

(57) ABSTRACT

A plug assembly having a core structural member and methods for manufacturing such plug assemblies are provided. A plug assembly can include a core structural member defining an elongated component having a bore therethrough. Several conductors can be inserted through the bore to be coupled to conductive regions used to transfer data and/or power. The conductive regions can include a ring or band that is provided axially over the structural member such that an external surface of the band can transfer signals. Each conductive region can include an arm extending from an internal surface of the band along the axis of the structural member. The arm may extend to a tip of the structural member so that a connector passing through the bore of the structural member can be connected to the arm (e.g., soldered to a tip of the arm). The structural member can include slots for receiving each arm. In some cases, the slots can be sized and disposed to provide a single order in which the contact regions can be slid over the structural member.

20 Claims, 5 Drawing Sheets

PLUG ASSEMBLY WITH CORE STRUCTURAL MEMBER

CROSS-REFERENCE TO RELATED APPLICATION

This application claims the benefit of previously filed U.S. Provisional Patent Application No. 61/326,102, filed Apr. 20, 2010, entitled "Audio Plug with Core Structural Member and Conductive Rings," and U.S. Provisional Patent Application No. 61/384,097, filed Sep. 17, 2010, entitled "Cable Structures and Systems Including Super-Elastic Rods and Methods for Making the Same." Each of these provisional applications is incorporated by reference herein in their entireties.

BACKGROUND OF THE INVENTION

Connectors are commonly used to connect one electronic device to another electronic device or to an accessory such as a headset. These connectors exist in all sorts of different configurations and enable passage of data and/or power. Examples of such connectors include USB connectors, Firewire connectors, audio plugs, video plugs, headset plugs, optical plugs, and magnetic connectors.

Traditional connector plugs (i.e., male connectors) can be constructed by combining several conductive regions with a thin lead. For example, each conductive region can include a metal ring providing an outer surface, and an interior tubular structure extending away from the tip of the plugs. During manufacture, the conductive regions can be stacked such that the tubular structures of each conductive region can be inserted into each other. The tubular structures can all be sized such that they extend to the same height, at which they may be connected to a lead. A dielectric material can be provided between the tubular structures to prevent shorting. To fit several tubular structures inserted into each other, along with the dielectric material, however, each tubular structure may be very thin. This structure may have a limited resistance to bending or other forces applied to the plug.

SUMMARY OF THE INVENTION

A plug assembly having a core structural member for improving the strength and stiffness of the audio plug, and methods for constructing the plug assembly are provided.

A plug assembly can include an elongated structural member extending along an axis to provide strength and structure for the plug assembly. The structural member can have the largest possible diameter that is smaller than a desired plug assembly diameter, while allowing for conductive paths between contact regions positioned over the structural member and conductors to which the plug is coupled. The structural member can include a bore extending through the structural member along the axis, for example to define a cylinder.

The plug assembly can include several conductors routed through the bore of structural member, from an end of the structural member that is away from the tip of the plug assembly towards the tip of the plug assembly. In some cases, the conductors can be secured to the tip of the structural assembly, or include a crimp or other feature that prevents the conductors from being removed through the bore. This may increase the strain resistance of the plug assembly.

The plug assembly can include at least one contact region that includes a ring inserted axially over the structural member, for example from the tip of the structural member. The ring can include an arm extending axially from an internal surface of the ring, where the arm extends towards the tip of the plug assembly (e.g., where the conductors exit from the bore of the structural member). The arm can then be coupled to a conductor to provide an electrically conductive path between the conductor and the outer surface of the ring. In some cases, the structural member can include one or more slots for receiving the arms of the contact regions. The slots can have different sizes, corresponding to different contact regions placed at different heights along the structural member. Dielectric material can be provided between adjacent contact regions to prevent shorting.

The plug assembly can include a tip contact region placed over the tip of the structural member. The tip contact region can include a depression or hole in which a portion of the structural member can be inserted (e.g., press fit). A conductor can be coupled to the inner surface of the depression to provide an electrically conductive path through the final conductive region. In some cases, the interface between the structural member and the tip contact region can serve to secure the other contact regions on the structural member.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1A:
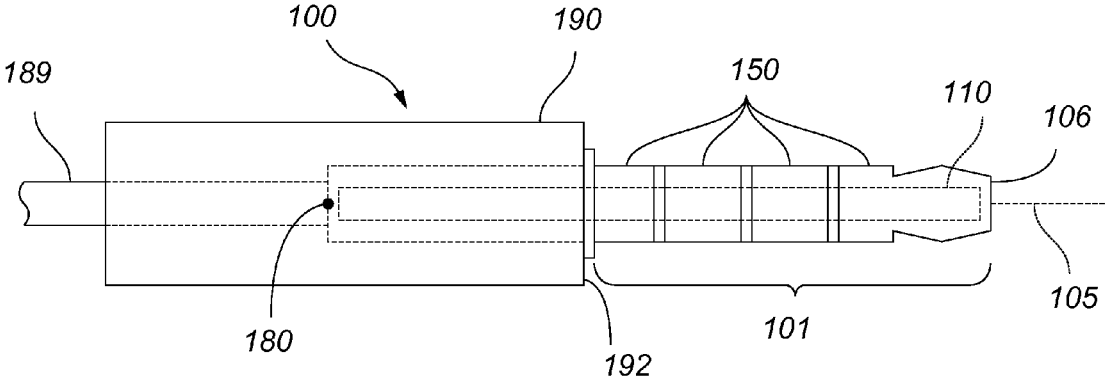
FIG. 1A shows an illustrative plug assembly constructed in accordance with some embodiments of the invention.

FIG. 1A shows an illustrative plug assembly constructed in accordance with some embodiments of the invention. Plug assembly 100 can provide functionality related to audio signals, visual signals, data signals, power signals, or other types of electrical signals. Although plug assembly 100 corresponds to an audio plug assembly, it will be understood that embodiments described herein can apply to any type of plug assembly or connector.

Plug assembly 100 can include elongated plug 101 that extends axially along axis 105, such that tip 106 of plug 101 forms a tip of plug assembly 100. Plug 101 can include one or more conductive regions 150 that are spaced apart axially along axis 105. While the embodiment shown in FIG. 1A includes four conductive regions, any number of conductive regions may be used depending on the needs of the plug assembly.

Plug assembly 100 can include housing 190 that is coupled to elongated plug 101 and provides a handle for enabling a user to manipulate to insert or remove plug assembly 100 from an electronic device. Housing 190 can include mating surface 192 substantially defining a plane that is perpendicular to plug axis 105. Mating surface 192 can be located adjacent to a portion of plug 101 that is opposite tip 106 (e.g., a portion of plug 101 that is not within housing 190). Mating surface 192 can be defined to abut a corresponding mating surface of an electronic device having a female connector for receiving plug 101. In this manner, mating surface 192 can provide a limit to how far plug 101 is inserted into an electronic device.

In some embodiments, plug assembly 100 may include a strain relief member to make a structurally robust connection between a plug and a cable, printed circuit board, or other such component. For example, plug assembly 100 may include a strain relief member disposed around termination point 180 to strengthen the connection and interface between plug 101 and cable 189. In some embodiments, termination point 180 may be covered by a housing, body, or enclosure. For example, termination point 180 may be enclosed within housing 190. In embodiments including a cable (e.g., cable 189), housing 190 may form a portion of the strain relief member. In some cases, plug 101 can include a core structural member 110 that also serves to provide strain relief for plug assembly 100, as well as increasing the overall strength of the plug assembly. Features of the structural member will be discussed in more detail below.

Figure 1B:
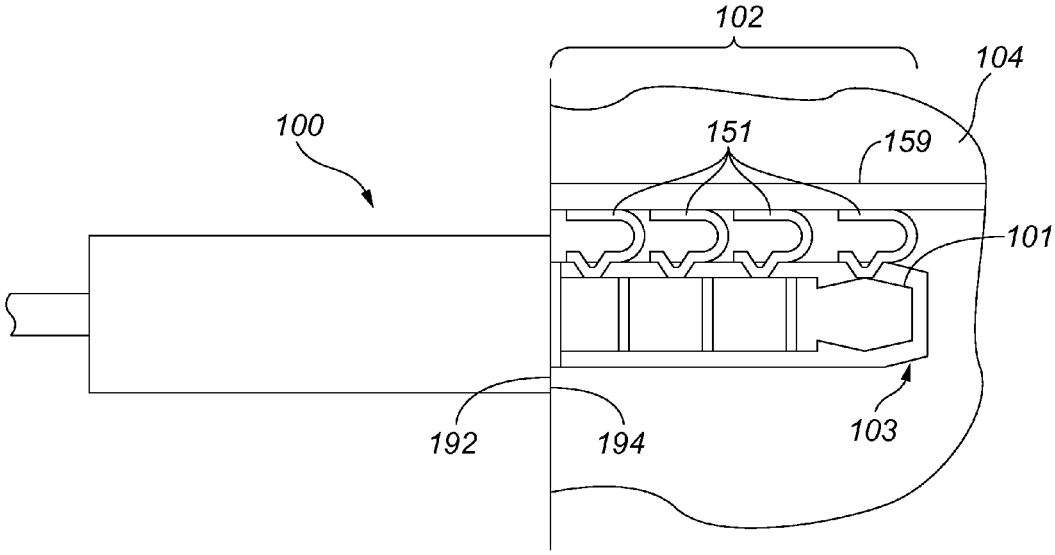
FIG. 1B shows a sectional view of an illustrative plug assembly inserted in a female connector in accordance with one embodiment of the invention.

Referring to FIG. 1B, plug assembly 100 can be coupled to connector 102 of electronic device 104 by inserting plug 101 into jack 103 (e.g., an aperture) in connector 102. When the plug assembly is coupled to the connector, mating surface 192 on plug assembly 100 may abut mating surface 194 on connector 102 or on the electronic device 104. Moreover, when the plug assembly is coupled to the connector, contacts 151 disposed within jack 103 may come into contact with conductive regions 150 of plug 101. Contacts 151 may, for example, be electrical contacts configured to extend into jack 103 (e.g., coupled with a spring) so that contacts 151 come into contact with conductive regions 150 of plug 101. Contacts 151 may be spaced apart so that each contact will only couple with a single conductive region of plug 101. Contacts in connector 102 may be coupled with a cable, printed circuit board, or any other suitable component to provide signals to device 104. For example, contacts 151 may be coupled to printed circuit board 159, which can provide electrical signals to components of electronic device 104. Electrical signals can then pass between circuit board 159, one or more contacts 151, and one or more corresponding conductive regions 150.

Referring back to FIG. 1A, plug assembly 100 may include termination point 180 at which plug 101 may be structurally coupled to a cable, printed circuit board, or any other similar device. For example, leads corresponding to each conductive region 150 of plug 101 may be coupled with individual conductors of cable 189 at termination point 180. In some embodiments, termination point 180 can be located at different positions within housing 190 (e.g., near tip 106, or at an end of plug 101 opposite tip 106 as shown in FIG. 1A).

Figure 2:
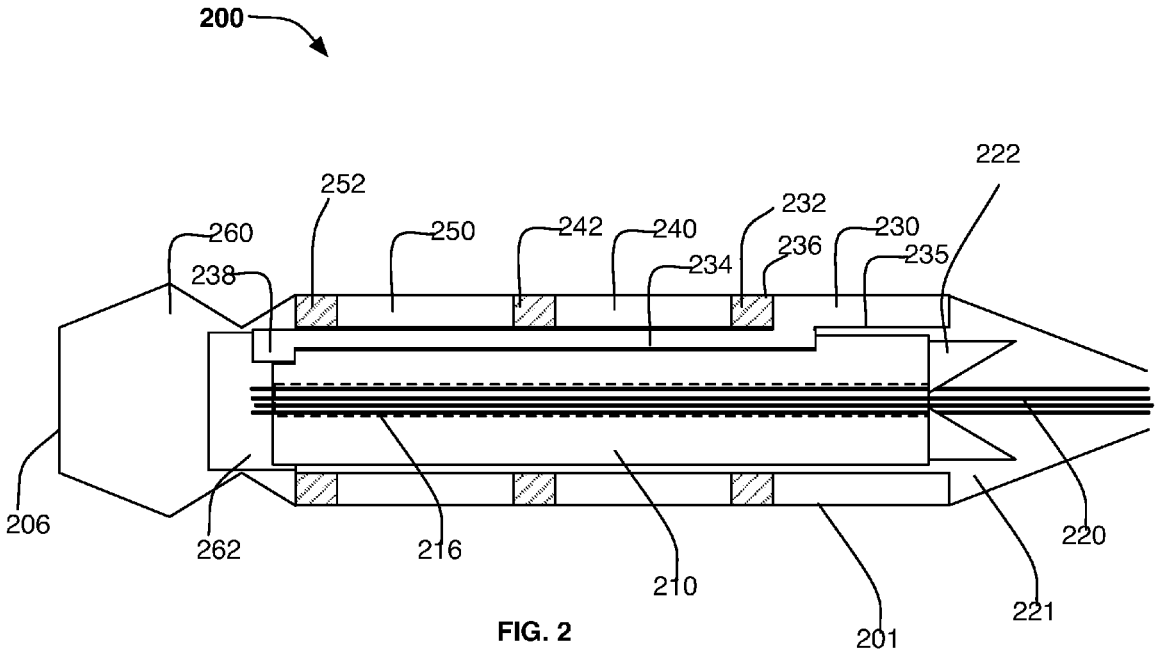
FIG. 2 shows a sectional view of an illustrative plug assembly having a core structural member in accordance with some embodiments of the invention.

As discussed above, plug 101 can include a core structural member (e.g., structural member 110, shown in dotted lines) to provide a stiffer plug. FIG. 2 is a sectional view of an illustrative plug assembly having a core structural member in accordance with some embodiments of the invention. Plug assembly 200 can include some or all of the features of other plug assemblies described herein. Plug assembly 200 can include structural member 210 providing mechanical stiffness for the plug assembly. Structural member 210 can be constructed from a single piece of material, or include no discontinuities to increase the strength of structural member 210. Structural member 210 can be constructed from any suitable material including, for example, from a plastic (e.g., a plastic having embedded particles for providing additional structural properties), metal (e.g., steel), composite material, or a combination thereof. In some embodiments, the particular material selected for structural member 210 can be selected based on mechanical properties (e.g., a desired mechanical stiffness or resistance to bending, compression, or tension). Several materials can be combined to form structural member 210, for example as part of a manufacturing process for the member (e.g., embed fibers in a molding process).

In some cases, an exterior surface of core structural member 210 can be electrically insulated to prevent shorting among conductive regions of plug assembly 200. For example, a non-conductive layer can be coated on an external surface structural member 210 (e.g., plastic may be overmolded on a steel member, or a fluorinated ethylene propylene layer). A non-conductive layer can be provided on any suitable surface of structural member 210 including, for example, on both inner and outer surfaces of structural member 210 (e.g., on a surface of bore 216, described below). In some cases, however, no layer may be necessary on the inner surface of the bore. In some embodiments, structural member 210 can instead be constructed from a non-conductive material, and therefore not require any insulating coating.

Structural member 210 can have any suitable disposition within plug assembly 200. In some cases, structural member 210 may be disposed entirely or partially along the length of elongated plug 201 of plug assembly 200. For example, structural member 210 can include a cylindrical component extending through a center of plug 201. In some embodiments, structural member 210 may extend proximally past at least the mating surface of a housing (e.g., housing 190, FIG. 1) such that a portion of structural member 210 is enclosed within the housing. In some cases, structural member can extend adjacent to or abut a termination point at which conductors are coupled to plug 201. In one particular embodiment, structural member 210 may substantially extend from tip 206 of plug 201 to a termination point.

Structural member 210 can have any suitable shape. For example, the structural member can define an elongated component that extends axially along a portion of plug 201, having a cable end (e.g., adjacent to region 222) and a tip end (e.g., near tip 206). Structural member 210 can have any suitable thickness within the plug. In particular, it may be desirable for the wall thickness to be as large as possible to provide sufficient mechanical strength to prevent or reduce failure of plug assembly 200. The overall thickness (e.g., the outermost diameter) of the structural member can be limited by different factors including, for example, the maximum plug diameter (e.g., 3.5 mm), space required for providing contact regions and connecting arms for coupling the contact regions to a cable, insulating layers, or any combinations thereof.

Structural member 210 can have any suitable cross-section, including a variable or constant cross-section. In some embodiments, structural member 210 can have a substantially circular or oval cross-section, such that structural member 210 defines a cylinder or a tube. Structural member 210 can include a substantially smooth cross-section to reduce regions for stress concentrations. In some embodiments, structural member 210 can include one or more slots, flanges, extensions, openings, or other features for retaining or receiving elements from the plug (e.g., contact portions or regions, or cables). For example, structural member 210 can include one or more openings, extensions, prongs, or other features to which a cable can be tied. In particular, structural member 210 can include an opening near the tip of structural member 210 (not shown in FIG. 2) through which conductors can be coupled or tied to secure the conductors in the plug assembly.

In some embodiments, structural member 210 can include bore 216 extending through the length of the structural member and through which one or more conductors 220 can be fed. For example, structural member 210 can include an opening extending through the center of the structural member sized to receive conductors 220. Bore 216 can have any suitable size, including for example a size selected based on a desired number of conductors to be attached to the plug, or structural requirements with respect to mechanical properties of structural member 210. For example bore 216 can be sized to receive four distinct conductors. In some cases, each conductor can include a tensile member, at least one conductive wire (which can be coated with a dielectric), and an insulating outer shell (e.g., tubing). In some cases, structural member 216 can include several holes or bores 216, each operative to receive one or more conductors.

Conductors 220 can be secured in plug 201 using any suitable approach. In some embodiments, conductors 220 can be secured at or near one or both ends of structural member 210. For example, cables can be glued, molded, or crimped in region 222 of structural member 210. This approach can provide an initial support to prevent the conductors from being disconnected from plug 201 (e.g., resist to strain applied to plug assembly 200). In some cases, region 222 can include additional material forming a cover or outer shell 221 serving as a strain relief for the cable (e.g., a larger molded region, or an overmold).

In some cases, conductors 220 can be fed into bore 216 such that conductors 220 extend through the entirety of bore 216. In this manner, a portion of the conductors may extend past an end of structural member 210 so that the conductors can be electrically connected to conductive regions of the plug assembly, as described in more detail below. For example, conductors can be threaded out from the tip of structural member 210, and re-directed back over structural member 210 towards region 222.

Different approaches can be used to secure one or more conductors 220 to structural member 210. In some cases, a portion of each conductor can be used to secure the conductors to structural member 220. For example, a tensile member can be tied off, include a crimp, or have any other feature that secures a conductor within bore 216, or prevents a conductor from being removed from bore 216. In some cases, an adhesive, overmold, or other such approach can be used to secure conductors 220.

Plug assembly 200 can include any suitable number of contact regions via which an electronic device can receive and provide signals through the plug assembly. In the example of FIG. 2, plug assembly 200 can include four contact regions. In particular, plug 200 can include contact regions 230, 240, 250 and 260. To ensure that signals can be transmitted through plug assembly 200 independent of an orientation of plug assembly 200 within an electronic device, contact regions 230, 240, 250 and 260 can be constructed such that they extend around a periphery of plug 201.

Each contact region can be constructed using any suitable approach. In some cases, contact regions 230, 240 and 250 can include rings that are successively inserted over structural member 210. In particular, contact region 230 can first be inserted from tip 206, then contact region 240, and finally contact region 250. In some embodiments, structural member 210 can include one or more features for retaining each contact region at a particular distance from tip 206. For example, structural member 210 can include a variable diameter, and the contact regions can include a variable thickness such that each contact region can be press fit onto the structural member around different portions of the structural member. The structural member diameter and the contact region thickness can be selected to key the contact regions and ensure that only a single order can be used to insert the contact regions over the structural member.

The contact regions can be electrically insulated from one another by insulating rings 232, 242 and 252. The insulating rings can be placed over structural member 210 in sequence between the contact regions. Each insulating ring can be constructed from any suitable insulating material including, for example, plastic. In some embodiments, insulating rings 232, 242 and 252 can instead be manufactured after all of the contact regions have been placed over the structural member. For example, plastic can be injection molded between the contact regions once they have been assembled.

To provide a conductive path for signals, each contact region can be constructed from a conductive material. For example, a contact region can be constructed from a metal (e.g., brass, gold, or silver). In some cases, contact regions can be constructed from an electrically insulating material, but include a conductive outer layer or coating that is exposed for contact within an electronic device when the plug assembly is constructed.

Different approaches can be used to connect individual conductors to each of the contact regions. In some cases, plug assembly 200 can include one or more pads (e.g., solder pads) corresponding to each of the conductive regions of plug assembly 200. The contact pads can be located near tip 206. In this manner, conductors 200 can be electrically connected to conductive regions 230, 240, and 250, respectively, of the plug assembly while providing the structural benefits of conductors passing through bore 216.

The conductive regions can include any suitable feature for providing contact pads near tip 206, or for providing an electrically conductive path between solder pads and the conductive regions disposed around structural member 210. In some embodiments, each contact region can include an arm or extension providing a conductive path between an outer surface of the contact region and the conductor coupled to the contact region. In the example of FIG. 2, arm 234 is shown only for contact region 230, though it will be understood that plug assembly 200 can include other extensions associated with other contact regions. Contact region 230 can include extension or arm 234 extending from inner surface 235 of the contact region. In particular, arm 234 can contact inner surface 235, and extend along the axis of structural member 210 toward tip 206 (e.g., extend in a direction substantially parallel to outer surface 236 of contact region 230), and be coupled to one of conductors 220.

Arm 234 can have any suitable size, including for example a small cross-section or thickness so that minimal space is required between an inner surface of contact regions 240 and 250 and structural element 210 for arm 234 to extend towards tip 206. In some cases, one or both of contact regions 240 and 250 and structural element 210 can include recesses or other features in which a portion of arm 234 can be recessed. Arm 234 can have any suitable length including, for example, at least the length required to reach the tip of structural member 210, where conductors of cable 220 are coupled to arm 234. In some embodiments, arm 234 can include tip 238 having a solder pad or other region or interface for being electrically connected to a conductor.

In some cases, arm 234 can include a dielectric coating to ensure that the arm does not short one or more of the contact regions behind which it is placed (e.g., so that arm 234 does not short contact region 240 or contact region 250). For example, arm 234 and inner surface 235 can include a dielectric coating, while front or outer surface 236 of contact region 230 can be exposed for connecting with an electronic device. It may be beneficial to instead or in addition provide a dielectric coating on the back surface of each contact region to provide several layers of insulation between the contact regions of the plug (e.g., an insulation layer on the contact region, and an insulating layer on the arm passing adjacent to the inner surface of the contact region).

In contrast with contact regions 230, 240, and 250, contact region 260 may not extend entirely around structural member 210. Instead, contact region 260 can form a tip of plug assembly 200. Contact region 260 can therefore be coupled to a conductor using a different approach. In some embodiments, contact region 260 can include hole or hollow depression 262 on which a contact pad can be exposed, such that a conductor can be soldered to the contact region within depression 262. In some embodiments, depression 262 can in addition provide space in which conductors can be coupled to the arms of each of contact regions 230, 240, and 250.

To provide a structurally and mechanically sound plug, contact region 260 can be coupled to structural member 210 using different approaches. In some embodiments, contact region 260 can be press fit onto a tip of structural member 210 (e.g., such that a portion of structural member 210 fits within depression 262). Contact region 260 can extend onto structural member 210 by any suitable amount including, for example, an amount that captures any free space that might exist between conductive regions 230, 240, 250, and dielectric rings 232, 242, and 252. In this manner, the interface between contact region 260 and structural member 210 can ensure that plug assembly 200 is structurally sound.

Figure 3:
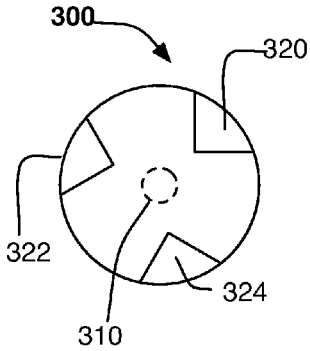
FIG. 3 shows a sectional view of an illustrative structural member used in a plug assembly in accordance with one embodiment of the invention.
Figure 4:
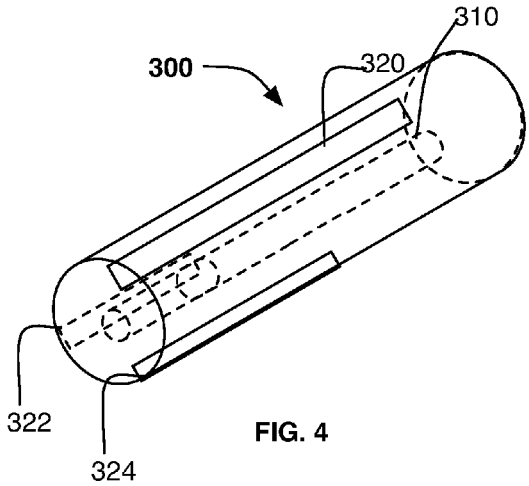
FIG. 4 shows a perspective view of an illustrative structural member used in a plug assembly in accordance with one embodiment of the invention.

The arms of each contact region can be distributed around the structural member using any suitable approach. FIG. 3 is a sectional view of an illustrative structural member used in a plug assembly in accordance with one embodiment of the invention. FIG. 4 is a perspective view of an illustrative structural member used in a plug assembly in accordance with one embodiment of the invention. Structural member 300 can include some or all of the features of other structural members described herein. Structural member 300 include bore 310 through which conductors can extend and be secured at an end.

Different approaches can be used to create space for arms within the plug assembly. In some cases, structural member 300 can include several slots or recesses for receiving arms corresponding to each of the contact regions. For example, structural member 300 can include slots 320, 322 and 324. Each slot can have any suitable length including, for example, a length corresponding to the position of the corresponding contact region on the structural member. For example, slot 320 can be the longest, corresponding to the contact region farthest from the tip of the plug assembly (e.g., contact region 230, FIG. 2), slot 322 can be the next longest, corresponding to the middle contact region (e.g., contact region 240, FIG. 2), and slot 324 can be the shortest, corresponding to the sliding contact region that is nearest to the tip of the plug assembly (e.g., contact region 250, FIG. 2). In some embodiments, structural member 300 may not include a slot for the contact region forming the tip of the plug assembly (e.g., due to the manner in which the contact region is assembled to the plug assembly).

The slots can be distributed in any suitable pattern. For example, the slots can be distributed evenly or symmetrically around the structural member to enhance the mechanical integrity of the member (e.g., three slots spaced by 120 degrees). As another example, the slots can be placed adjacent to each other. As still another example, the slots can be at least in part combined (e.g., in a single slot) to reduce manufacturing costs.

Each slot can have any suitable size or shape. For example, each slot can have a constant or variable cross-section corresponding to dimensions of arms of the contact region. The cross-section of each slot can define any suitable shape such as, for example, a triangle, square, pentagon, polygon, circle, ellipsis, or an arbitrary shape. In some cases, each slot can have a different shape to key specific contact regions during assembly (e.g., if the arms of each contact regions have different shapes or cross-sections). In some embodiments, each slot can have a different size or shape (e.g., triangular, circular, or rectangular slot) to key the individual contact regions and arms.

Figure 5:
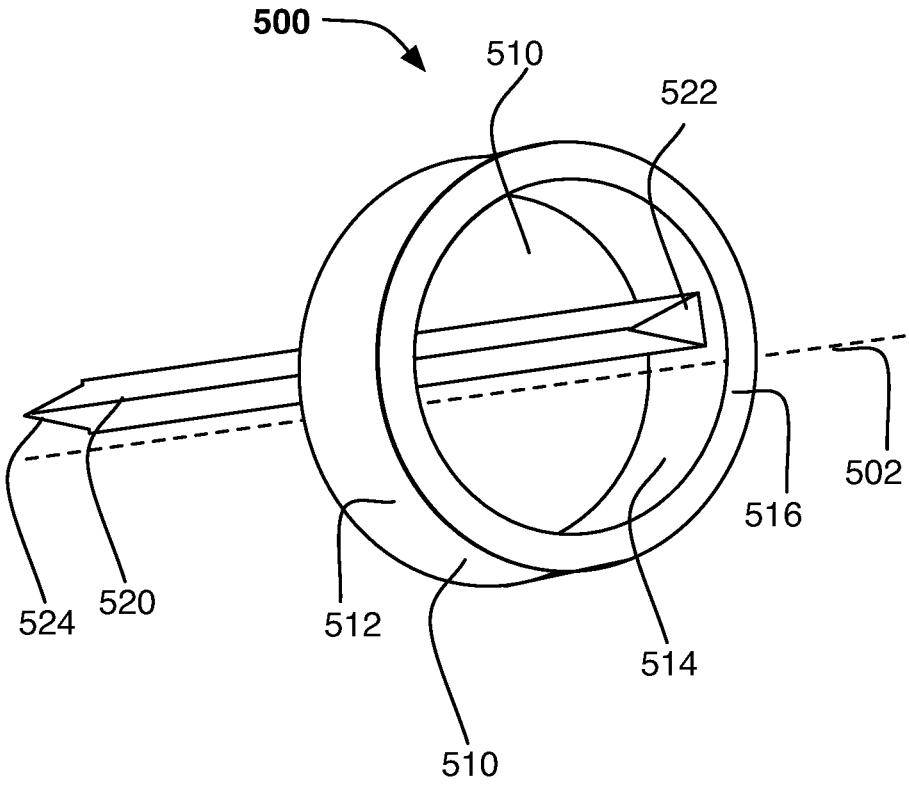
FIG. 5 shows a perspective view of an illustrative contact region having an arm in accordance with some embodiments of the invention.

FIG. 5 is a perspective view of an illustrative contact region having an arm in accordance with some embodiments of the invention. Contact region 500 can include ring or band 510 having center opening 511 for enabling band 510 to slide over a structural member. Band 510 can be defined, for example, as a rectangular or other shape swept around center axis 502. Band 510 can include outer contact surface 512 operative to come into contact with a connector of an electronic device, and inner surface 514 operative to be placed adjacent to the structural member. Band 510 can include upper surface 516 and a lower surface (not numbered) that are placed in contact with dielectric components to prevent electrical contact between contact region 500 and other contact regions of the plug assembly.

To provide an electrically conductive path between connectors routed through a bore of the structural member and outer surface 510 of contact region 500, contact region 500 can include arm 520 coupled to and extending from a portion of inner surface 514. In some cases, arm 520 can be coupled to other portions of contact region 500 (e.g., a lower surface). Arm 520 can extend along axis 502 (e.g., an axis that is perpendicular to a plane that includes upper surface 516 or the lower surface of contact region 500). The length of arm 520 can be selected, for example, based on the position of contact region 500 on the plug assembly.

First end 522 of arm 520 can be coupled to inner surface 514, while tip 526 of arm 520 can include a contact pad or other surface for being electrically coupled a conductor. For example, tip 526 can include a solder pad to which the conductor can be soldered. In some cases, tip 526 can have different dimensions relative to intermediate regions of arm 520 (e.g., a smaller arm to reduce the size of slots in the structural member, but a larger tip to provide a large pad for soldering).

Figure 6:
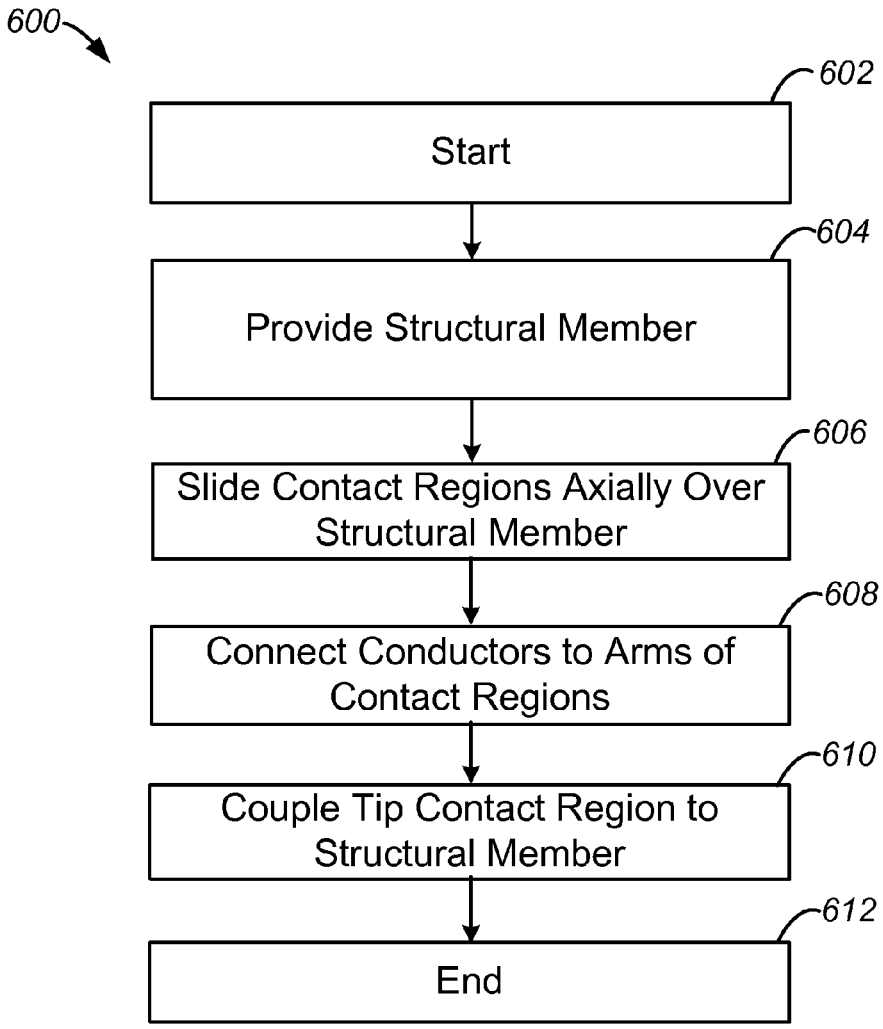
FIG. 6 is a flowchart of an illustrative process for assembling a plug assembly in accordance with one embodiment of the invention.

FIG. 6 is a flowchart of an illustrative process for assembling a plug assembly in accordance with one embodiment of the invention. Process 600 can begin at step 602. At step 604, a structural member can be provided. For example, a tubular or cylindrical member can be provided. The structural member can include a bore extending through the entirety of the structural member for receiving several conductors. At step 606, contact regions can be slid axially over the structural member. For example, several rings forming contact regions can be slid from the tip of the structural member towards an end of the structural member through which conductors are initially threaded. In some cases, an insulating ring can be positioned between adjacent contact regions to prevent shorting of individual contact regions. Each contact region can include an arm extending along the axis of the structural member such that a portion of the arm is exposed or accessible near the tip of the structural member.

At step 608, conductors can be coupled to the arms of the contact regions. For example, individual conductors can be soldered to pads incorporated on an end of each contact region arm. In some cases, the conductors can be fed through the structural member such that the conductors are coupled to the arms of the contact regions near the tip of the plug assembly. The conductors can be secured to the structural member to increase the resistance to strain and other deformation of the plug assembly. At step 610, a tip contact region corresponding to the tip of the plug assembly can be coupled to the structural member. For example, the tip contact region, which can include a hole or indentation, can be press fit onto the structural member. The tip contact region can serve to secure the band-type contact regions over the structural member to complete the plug. Process 600 can then end at step 612.

Figure 7:
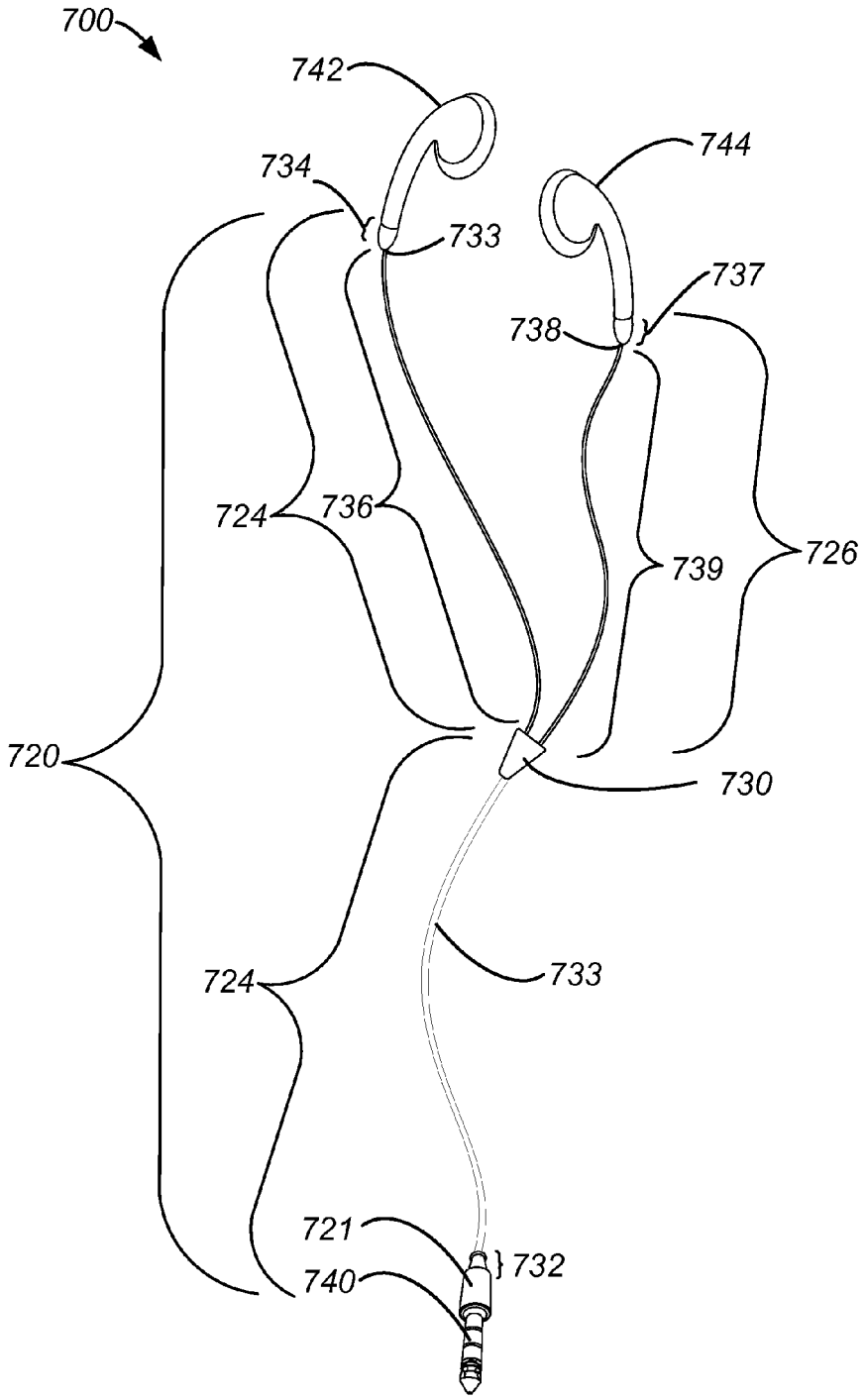
FIG. 7 shows a perspective view of an illustrative headset in accordance with some embodiments of the invention.

FIG. 7 shows an illustrative headset 700 having cable structure 720 that seamlessly integrates with non-cable components 740, 742, and 744. For example, non-cable components 740, 742, and 744 can be a male plug such as plug 100 of FIG. 1 or plug 200 of FIG. 2 in accordance with embodiments of the invention, left headphones, and right headphones, respectively. Cable structure 720 has three legs 722, 724, and 726 joined together at bifurcation region 730. Leg 722 may be referred to herein as main leg 722, and includes the portion of cable structure 720 existing between non-cable component 740 and bifurcation region 730. In particular, main leg 722 includes interface region 731, bump region 732, and non-interface region 733. Leg 724 may be referred to herein as left leg 724, and includes the portion of cable structure 720 existing between non-cable component 742 and bifurcation region 730. Leg 726 may be referred to herein as right leg 726, and includes the portion of cable structure 720 existing between non-cable component 744 and bifurcation region 730. Both left and right legs 724 and 726 include respective interface regions 734 and 737, bump regions 735 and 738, and non-interface regions 736 and 739.

Legs 722, 724, and 726 generally exhibit a smooth surface throughout the entirety of their respective lengths. Each of legs 722, 724, and 726 can vary in diameter, yet still retain the smooth surface.

Non-interface regions 733, 736, and 739 can each have a predetermined diameter and length. The diameter of non-interface region 733 (of main leg 722) may be larger than or the same as the diameters of non-interface regions 736 and 739 (of left leg 724 and right leg 726, respectively). For example, leg 722 may contain a conductor bundle for both left and right legs 724 and 726 and may therefore require a greater diameter to accommodate all conductors. In some embodiments, it is desirable to manufacture non-interface regions 733, 736, and 739 to have the smallest diameter possible, for aesthetic reasons. As a result, the diameter of non-interface regions 733, 736, and 739 can be smaller than the diameter of any non-cable component (e.g., non-cable components 740, 742, and 744) physically connected to the interfacing region. Since it is desirable for cable structure 720 to seamlessly integrate with the non-cable components, the legs may vary in diameter from the non-interfacing region to the interfacing region.

Bump regions 732, 735, and 737 provide a diameter changing transition between interfacing regions 731, 734, and 738 and respective non-interfacing regions 733, 736, and 739. The diameter changing transition can take any suitable shape that exhibits a fluid or smooth transition from any interface region to its respective non-interface region. For example, the shape of the bump region can be similar to that of a cone or a neck of a wine bottle. As another example, the shape of the taper region can be stepless (i.e., there is no abrupt or dramatic step change in diameter, or no sharp angle at an end of the bump region). Bump regions 732, 735, and 737 may be mathematically represented by a bump function, which requires the entire diameter changing transition to be stepless and smooth (e.g., the bump function is continuously differentiable).

Interface regions 721, 734, and 738 can each have a predetermined diameter and length. The diameter of any interface region can be substantially the same as the diameter of the non-cable component it is physically connected to, to provide an aesthetically pleasing seamless integration. For example, the diameter of interface region 721 can be substantially the same as the diameter of non-cable component 740. In some embodiments, the diameter of a non-cable component (e.g., component 740) and its associated interfacing region (e.g., region 731) are greater than the diameter of the non-interface region (e.g., region 733) they are connected to via the bump region (e.g., region 732). Consequently, in this embodiment, the bump region decreases in diameter from the interface region to the non-interface region.

In another embodiment, the diameter of a non-cable component (e.g., component 740) and its associated interfacing region (e.g., region 731) are less than the diameter of the non-interface region (e.g., region 733) they are connected to via the bump region (e.g., region 732). Consequently, in this embodiment, the bump region increases in diameter from the interface region to the non-interface region.

The combination of the interface and bump regions can provide strain relief for those regions of headset 710. In one embodiment, strain relief may be realized because the interface and bump regions have larger dimensions than the non-interface region and thus are more robust. These larger dimensions may also ensure that non-cable portions are securely connected to cable structure 720. Moreover, the extra girth better enables the interface and bump regions to withstand bend stresses.

The interconnection of legs 722, 724, and 726 at bifurcation region 730 can vary depending on how cable structure 720 is manufactured. In one approach, cable structure 720 can be a jointly formed multi-leg or single-segment unibody cable structure. In this approach all three legs are manufactured jointly as one continuous structure and no additional processing is required to electrically couple the conductors contained therein. That is, none of the legs are spliced to interconnect conductors at bifurcation region 730, nor are the legs manufactured separately and then later joined together. Some jointly formed multi-leg cable structures may have a top half and a bottom half, which are molded together and extend throughout the entire cable structure. Thus, although a mold-derived jointly formed multi-leg cable structure has two components (i.e., the top and bottom halves), it is considered a jointly formed multi-leg cable structure for the purposes of this disclosure. Other jointly formed multi-leg cable structures may exhibit a contiguous ring of material that extends throughout the entire cable structure.

In another approach, cable structure 720 can be a multi-segment unibody cable structure in which three discrete or independently formed legs are connected at a bifurcation region. A multi-segment unibody cable structure may have the same appearance of the jointly formed multi-leg cable structure, but the legs are manufactured as discrete components. The legs and any conductors contained therein are interconnected at bifurcation region 730. The legs can be manufactured, for example, using any of the processes used to manufacture the jointly formed multi-leg cable structure.

The cosmetics of bifurcation region 730 can be any suitable shape. In one embodiment, bifurcation region 730 can be an overmold structure that encapsulates a portion of each leg 722, 724, and 726. The overmold structure can be visually and tactically distinct from legs 722, 724, and 726. The overmold structure can be applied to the single or multi-segment unibody cable structure. In another embodiment, bifurcation region 730 can be a two-shot injection molded splitter having the same dimensions as the portion of the legs being joined together. Thus, when the legs are joined together with the splitter mold, cable structure 720 maintains its unibody aesthetics. That is, a multi-segment cable structure has the look and feel of jointly formed multi-leg cable structure even though it has three discretely manufactured legs joined together at bifurcation region 730. Many different splitter configurations can be used, and the use of some splitters may be based on the manufacturing process used to create the segment.

Cable structure 720 can include a conductor bundle that extends through some or all of legs 722, 724, and 726. Cable structure 720 can include conductors for carrying signals from non-cable component 740 to non-cable components 742 and 744. Cable structure 720 can include one or more rods constructed from a super-elastic material. The rods can resist deformation to reduce or prevent tangling of the legs. The rods are different than the conductors used to convey signals from non-cable component 740 to non-cable components 742 and 744, but share the same space within cable structure 720. Several different rod arrangements may be included in cable structure 720.

In yet another embodiment, one or more of legs 722, 724, and 726 can vary in diameter in two or more bump regions. For example, the leg 722 can include bump region 732 and another bump region (not shown) that exists at leg/bifurcation region 730. This other bump region may vary the diameter of leg 722 so that it changes in size to match the diameter of cable structure at bifurcation region 730. This other bump region can provide additional strain relief. Each leg can have any suitable diameter including, for example, a diameter in the range of 0.4 mm to 1 mm (e.g., 0.8 mm for leg 720, and 0.6 mm for legs 722 and 724).

A plug assembly having some or all of the features described in embodiments above can be used with any suitable type of cable structure. For example, a plug assembly can be used with a cable structure constructed as a jointly formed multi-leg cable, or as a single-segment unibody cable structure. As another example, a plug assembly can be used with a cable structure constructed as a multi-segment cable structure in which several independently constructed legs are connected at a bifurcation region.

While the above description occasionally refers to embodiments of audio plugs and methods for manufacturing audio plugs, it is understood that the plug and methods of manufacture can be applied to any type of plug for transmitting any type of electrical signal. For example, the above description can be applied to plugs for transmitting electrical power, data, audio, or any combination of the above between electronic devices.

The previously described embodiments are presented for purposes of illustration and not of limitation. It is understood that one or more features of an embodiment can be combined with one or more features of another embodiment to provide systems and/or methods without deviating from the spirit and scope of the invention.

What is claimed is:

1. A plug assembly, comprising:

an elongated structural member extending along an axis, the structural member comprising a bore extending through the structural member along the axis;

a plurality of conductors routed through the bore towards an end of the structural member adjacent to a tip of the plug assembly; and at least one contact region comprising a ring inserted axially over the structural member, the contact region comprising an electrically conductive arm extending from the ring along the axis of the structural member towards the end of the structural member, wherein a conductor of the plurality of conductors is coupled to an end of the arm.

2. The plug assembly of claim 1, further comprising:

a tip contact region comprising a depression operative to be coupled to the end of the structural member.

3. The plug assembly of claim 1, wherein:

the elongated structural member defines a cylinder.

4. A plug assembly, comprising:

an elongated structural member extending along an axis, the structural member comprising a bore extending through the structural member along the axis;

a plurality of conductors routed through the bore towards an end of the structural member adjacent to a tip of the plug assembly; and at least one contact region comprising a ring inserted axially over the structural member, the contact region comprising an arm extending from the ring along the axis of the structural member towards the end of the structural member, wherein a conductor of the plurality of conductors is coupled to an end of the arm, and the structural member comprises a slot extending along the axis, the slot operative to receive the arm when the at least one contact region is inserted axially over the structural member.

5. The plug assembly of claim 4, wherein:

the structural member comprises a plurality of slots, each slot of the plurality of slots operative to receive an arm from different contact regions inserted axially over the structural member.

6. The plug assembly of claim 5, wherein:

each of the plurality of slots have different lengths measured from the end of the structural member.

7. The plug assembly of claim 5, wherein:

the plurality of slots have different cross-sections each associated with a shape of an arm of the different contact regions.

8. The plug assembly of claim 5, wherein:

the plurality of slots are evenly distributed around an outer surface of the structural member.

9. The plug assembly of claim 1, further comprising:

an outer shell molded over a portion of the conductors adjacent to an end of the structural member in which the conductors are inserted.

10. A method for constructing a plug assembly, comprising:

providing a structural member, wherein the structural member comprises a bore extending through the structural member along an elongated axis of the structural member;

sliding at least one contact region axially over the structural member along the elongated axis, wherein the contact region comprises a ring having an arm extending from an inner surface of the contact region along the elongated axis;

connecting a conductor to an end of the arm, wherein the conductor is fed through the bore of the structural member and is coupled to the end of the arm in a region adjacent to a tip of the structural member; and coupling a tip contact region to the tip of the structural member.

11. The method of claim 10, further comprising:

preventing the conductor from being removed through the bore of the structural member.

12. The method of claim 10, further comprising:

coupling the conductor to the tip of the structural member.

13. The method of claim 10, wherein coupling the tip contact region further comprises:

press fitting the tip contact region onto the tip of the structural member.

14. The method of claim 10, further comprising:

providing dielectric rings between each of the at least one contact regions.

15. A method for constructing a plug assembly, comprising:

providing a structural member, wherein the structural member comprises a bore extending through the structural member along an elongated axis of the structural member;

sliding at least one contact region axially over the structural member along the elongated axis, wherein the contact region comprises a ring having an arm extending from an inner surface of the contact region along the elongated axis;

connecting a conductor to an end of the arm, wherein the conductor is fed through the bore of the structural member and is coupled to the end of the arm in a region adjacent to a tip of the structural member;

coupling a tip contact region to the tip of the structural member;

sliding a plurality of contact regions over the structural member, wherein each of the plurality of contact regions comprises an arm extending along the elongated axis; and aligning an arm of each of the plurality of contact regions with one of a plurality of slots in an exterior surface of the structural member, wherein the plurality of slots extend along the elongated axis.

16. The method of claim 15, wherein:

each of the plurality of slots is associated with an arm of a particular one of the plurality of contact regions.

17. An audio plug assembly, comprising:

a cylindrical structural member extending along an axis, the cylindrical structural member comprising a hole extending from a cable end to a tip end of the cylindrical structural member along the axis;

at least two contact regions each comprising:

a ring having an inner diameter that corresponds to a diameter of the cylindrical structural member; and an arm extending from an inner surface of the ring, the arm extending along the axis, wherein the at least two contact regions are positioned in sequence axially over the cylindrical structural member such that the arms of the at least two contact regions extend towards the tip end of the cylindrical structural member;

a plurality of conductors each operative to transfer one of power and data, the plurality of conductors fed through the hole of the cylindrical structural member from the cable end to the tip end, wherein at least one of the plurality of conductors is coupled to each of the arms; and a tip conductive region comprising a depression, wherein the tip conductive region is operative to be coupled to the tip end of the cylindrical structural member.

18. The plug assembly of claim 17, further comprising:

at least one dielectric ring positioned between the at least two conductive regions.

19. An audio plug assembly, comprising:

a cylindrical structural member extending along an axis, the cylindrical structural member comprising a hole extending from a cable end to a tip end of the cylindrical structural member along the axis, and at least two slots;

at least two contact regions each comprising:

a ring having an inner diameter that corresponds to a diameter of the cylindrical structural member; and an arm extending from an inner surface of the ring, the arm extending along the axis, wherein the at least two contact regions are positioned in sequence axially over the cylindrical structural member such that arms of each of the at least two contact regions extend towards the tip end of the cylindrical structural member and are received in each of the at least two-slots;

a plurality of conductors each operative to transfer one of power and data, the plurality of conductors fed through the hole of the cylindrical structural member from the cable end to the tip end, wherein at least one of the plurality of conductors is coupled to each of the arms; and a tip conductive region comprising a depression, wherein the tip conductive region is operative to be coupled to the tip end of the cylindrical structural member.

20. The plug assembly of claim 17, wherein:

one of the plurality of conductors is coupled to the tip conductive region.

* * * * *